United States Patent [19]

Boffardi

[11] 4,206,075

[45] Jun. 3, 1980

[54] CORROSION INHIBITOR

[75] Inventor: Bennett P. Boffardi, Bethel Park, Pa.

[73] Assignee: Calgon Corporation, Pittsburgh, Pa.

[21] Appl. No.: 903,169

[22] Filed: May 5, 1978

[51] Int. Cl.[2] ..... C23F 11/16; C23F 11/14

[52] U.S. Cl. ..... 252/389 A; 252/181; 210/59; 210/60; 260/961; 422/15

[58] Field of Search ..... 252/389 A, 180, 181; 210/59, 60; 422/15; 260/961

[56] References Cited

U.S. PATENT DOCUMENTS

| | | | |
|---|---|---|---|
| 3,483,133 | 12/1969 | Hatch et al. | 252/389 A |
| 3,510,436 | 5/1970 | Silverstein et al. | 252/389 A |
| 3,532,639 | 10/1970 | Hatch | 252/389 A |
| 3,669,047 | 10/1972 | Putnoy | 252/181 |
| 3,723,333 | 3/1973 | Freyhold | 252/180 |
| 3,932,303 | 1/1976 | Hollingshad | 252/389 A |
| 3,935,125 | 1/1976 | Jacob | 252/389 A |
| 3,992,318 | 11/1976 | Gaupp et al. | 252/389 A |
| 4,076,501 | 2/1978 | Harris et al. | 252/389 A |

FOREIGN PATENT DOCUMENTS 1201334 8/1970 United Kingdom .

*Primary Examiner*—Benjamin R. Padgett
*Assistant Examiner*—Irwin Gluck
*Attorney, Agent, or Firm*—Mario A. Monaco; Martin L. Katz

[57] ABSTRACT

Use of amino tris(methylene phosphonic acid) and 1-hydroxyethylidene-1,1-diphosphonic acid in a ratio of from about 1:1 to about 3:1 by weight to inhibit corrosion of low carbon steel in aqueous systems.

7 Claims, No Drawings

CORROSION INHIBITOR

This invention relates to the inhibition of corrosion in aqueous systems.

More particularly, this invention relates to the use of compositions containing amino tris (methylene phosphonic acid) and 1-hydroxyethylidene-1,1-diphosphonic acid in a ratio of from about 1:1 to about 3:1 by weight to inhibit corrosion of low carbon steel in aqueous systems.

Oxygen corrosion is, of course, a serious problem in any metal-containing aqueous system. The corrosion of iron and steel is of principal concern because of their extensive use in many types of industrial and municipal water systems.

While amino tris(methylene phosphonic acid) and 1-hydroxyethylidene-1,1-diphosphonic acid have been used to inhibit the corrosion of metals in aqueous systems, we have found that greatly improved results are obtained when compositions containing amino tris(methylene phosphonic acid) and 1-hydroxyethylidene-1,1-diphosphonic acid in a ratio of from about 1:1 to about 3:1 by weight are used to inhibit the corrosion of low carbon steel in aqueous systems. The compositions of this invention will effectively inhibit corrosion of low carbon steels when maintained in an aqueous system at a concentration of at least 0.1 mg/liter. The preferred concentration is at least 15 mg/liter.

Other conventional inhibitors such as inorganic polyphosphates, zinc, soluble zinc salts, chromates, benzotriazole, tolyltriazole or mercaptobenzothiazole may be added to the final formulation in varying amounts to improve its usefulness in a wider variety of industrial applications where both low carbon steel and copper or its alloys are present in the same system. Similarly, polymeric dispersants such as polyacrylates, polyacrylamides or polymers of 2-acrylamido methylpropane sulfonic acid may also be incorporated in the final formulation in varying amounts. The molecular weights of these dispersants may vary from as low as less than 1000 to as high as several million.

In order to demonstrate the effectiveness of the compositions of this invention, a coupon immersion test was conducted in a test system which consists of a cylindrical battery jar with a capacity of 8 liters. A Haake constant temperature immersion circulator (Model E-52) was used to control the solution temperature and agitate the controlled bath. The unit contained a 1000 watt fully adjustable stainless steel heater which permitted temperature control to +0.01° C., and a 10 liter per minute pump with a built-in pressure nozzle agitator that ensured high temperature uniformity in the bath. A mercury contact thermoregulator was used as the temperature sensing element. The pH of the solution was controlled with a Kruger and Eckels Model 440 pH Controller. This unit is capable of turning power on and off to a Dias mini-pump whenever the pH of the corrosive liquid environment fell below the set point. The peristaltic Dias pump, with a pumping capacity of 20 ml per hour, maintained the solution pH with the addition of 10% sulfuric acid. Standard glass and saturated calomel electrodes were used as the sensing elements. The bath was continuously aerated at the rate of 60 cc per minute through a medium porosity plastic gas dispersion tube to ensure air saturation. Two SAE-1010 steel coupons, each having a surface area of 4.2 square inches, were suspended by a glass hook. The solution volume to metal surface area ratio for the larger beaker test was approximately 1000:1.

The tests were conducted in water having a composition of 71 mg/liter calcium ion, 100 mg/liter bicarbonate ion, 224 mg/liter chloride ion and 224 mg/liter sulfate ion. The system was treated with 15 mg/liter of corrosion inhibitor. After seven days, the water composition and inhibitor level was totally replenished; and at the expiration of fourteen days the tests were terminated.

The corrosion rates shown in Table I are the average weight loss of low carbon steel coupons expressed in mils per year (m.p.y.). The coupons were prepared, cleaned and evaluated according to the ASTM method G1.

The results of this test are reported in the following table.

TABLE I

STEEL CORROSION INHIBITION

| Inhibitor | Concentration (mg/l) | pH | Temperature °C. | Corrosion Rate (mpy) |
|---|---|---|---|---|
| 1:1 AMP:HEDP | 15 | 7.5 | 50 | 5.0 |
| 2:1 AMP:HEDP | 15 | 7.5 | 50 | 3.1 |
| 3:1 AMP:HEDP | 15 | 7.5 | 50 | 9.4 |
| 2.5:9 AMP:HEDP | 15 | 7.5 | 50 | 21.4 |
| AMP | 15 | 7.5 | 50 | 18.0 |
| HEDP | 15 | 7.5 | 50 | 27.1 |
| 1:1 AMP:HEDP | 15 | 8.0 | 50 | 4.2 |
| 2:1 AMP:HEDP | 15 | 8.0 | 50 | 2.9 |
| 3:1 AMP:HEDP | 15 | 8.0 | 50 | 2.7 |
| 2.5:9 AMP:HEDP | 15 | 8.0 | 50 | 6.7 |
| AMP | 15 | 8.0 | 50 | 23.3 |
| HEDP | 15 | 8.0 | 50 | 16.4 |

*AMP = amino tris(methylene phosphonic acid)
*HEDP = 1-hydroxyethylidene-1,1-diphosphonic acid

I claim:

1. A low carbon steel corrosion inhibiting composition consisting essentially of from about 1 part by weight to about 3 parts by weight amino tris(methylene phosphonic acid) and about 1 part by weight 1-hydroxyethylidene-1,1-diphosphonic acid or their water-soluble salts.

2. A corrosion inhibiting composition as in claim 1 which also contains at least one member selected from the group consisting of inorganic polyphosphates, zinc, soluble zinc salts, chromates, benzotriazole, tolyltriazole and mercaptobenzothiazole.

3. A corrosion inhibiting composition as in claim 1 which also contains a polymeric dispersant.

4. A method of inhibiting the corrosion of low carbon steel in aqueous systems which comprise maintaining in the water of said system at least about 0.1 mg/liter of a corrosion inhibiting composition consisting essentially of from about 1 part by weight to about 3 parts by weight amino tris(methylene phosphonic acid) and about 1 part by weight 1-hydroxyethylidene-1,1-diphosphonic acid or their water-soluble salts.

5. A method as in claim 4 wherein the concentration of the corrosion inhibiting composition is at least about 15 mg/liter.

6. A method as in claim 4 wherein the corrosion inhibiting composition also contains at least one member selected from the group consisting of inorganic polyphosphates, zinc, soluble zinc salts, chromates, benzotriazole, tolyltriazole and mercaptobenzothiazole.

7. A method as in claim 4 wherein the corrosion inhibiting composition also contains a polymeric dispersant.

* * * * *